US005102000A

United States Patent [19]

Feltman, III

[11] Patent Number: 5,102,000

[45] Date of Patent: Apr. 7, 1992

[54] DRINK MUG

[76] Inventor: Charles H. Feltman, III, 2569 Marian Way, San Luis Obispo, Calif. 93401

[21] Appl. No.: 729,227

[22] Filed: Jul. 12, 1991

[51] Int. Cl.[5] ..... B65D 41/06

[52] U.S. Cl. ..... 220/297; 220/293; 220/713

[58] Field of Search ..... 220/90.2, 90.4, 90.6, 220/293, 295, 297, 301, 302, 711, 713; 215/332

[56] References Cited

U.S. PATENT DOCUMENTS

| | | | |
|---|---|---|---|
| 3,784,047 | 1/1974 | Couper | 220/301 |
| 4,582,218 | 4/1986 | Ross | 220/290 |
| 5,018,636 | 5/1991 | Ross | 220/90.4 |

*Primary Examiner*—Stephen Marcus
*Assistant Examiner*—Nova Stucker
*Attorney, Agent, or Firm*—Harris, Kern, Wallen & Tinsley

[57] ABSTRACT

A drink mug with open top, closed bottom, and a body portion between the top and bottom, an inwardly projecting ring in the body portion, spaced vertical passages in the ring, spaced notches in the body portion below the ring, a lid for resting on the ring, and latch members carried on the lid and projecting downward therefrom with the latch members passing through the vertical passages as the lid is positioned on the ring, and with the latch members positioned in the notches when the lid is rotated on the ring latching the lid in place on the ring. In the preferred embodiment flexible fingers connecting the latch members to the lid, with two vertical passages opposite each other, and two notches opposite each other and at 90° to the vertical passages.

10 Claims, 1 Drawing Sheet

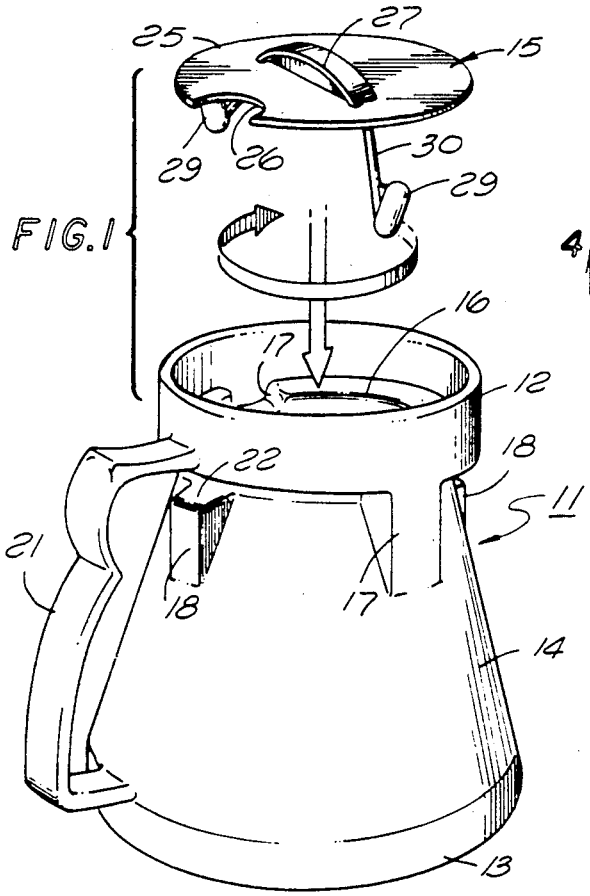
FIG. 1
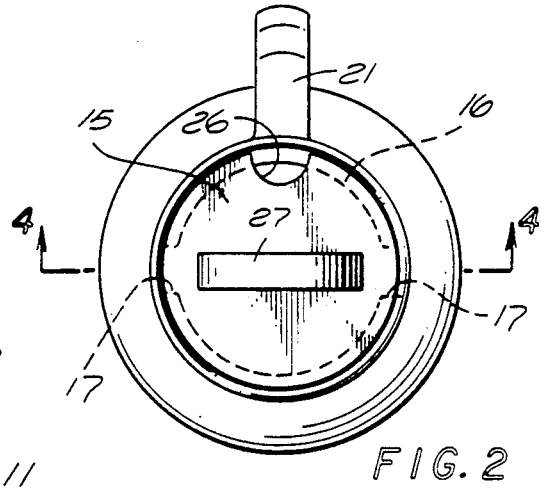
FIG. 2
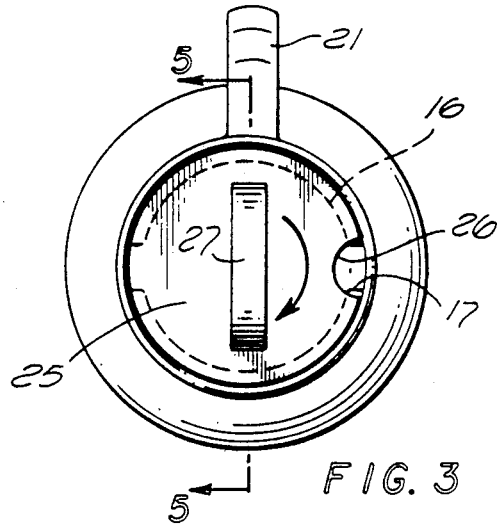
FIG. 3
FIG. 4
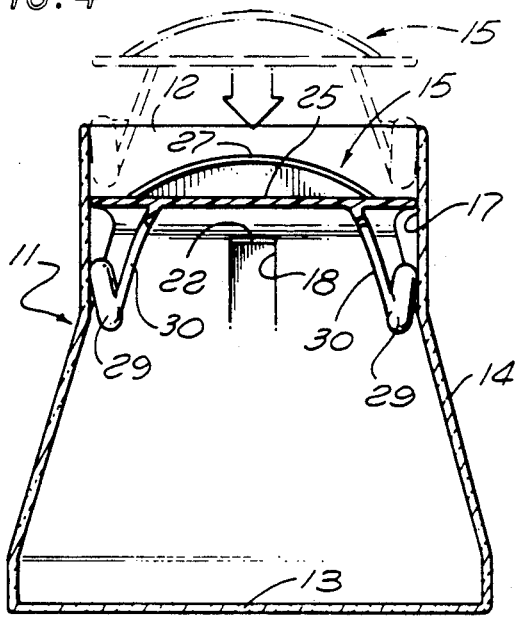
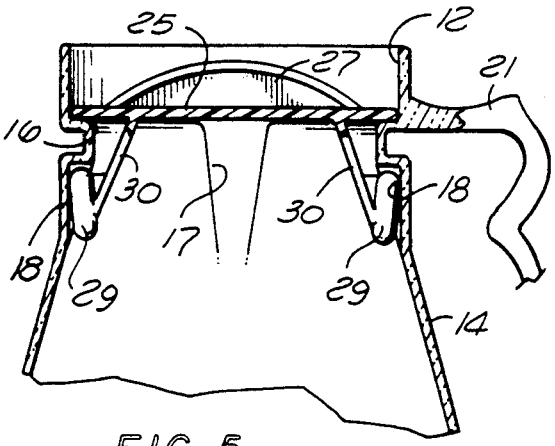
FIG. 5

DRINK MUG

BACKGROUND OF THE INVENTION

The present invention relates to containers for liquids, such as a drink mug. More particularly, it relates to a mug which will tend to maintain the contents hot or cold, permit the user to drink from the mug, and reduce the likelihood of splashing.

Double wall containers, such as vacuum bottles and the like, have been used for maintaining the temperature of the contents. Such devices are relatively expensive, and are not handy for drinking and hence are seldom used by a drink consumer.

A variety of glasses, cups and mugs, herein all referred to as mugs, are widely used by the drinker, typically with the mug being filled or refilled from a vacuum bottle or other source of hot or cold liquid.

More recently, mugs with removable lids for reducing temperature change of the contents while at the same time providing for retaining the liquid should the mug be tipped and for drinking from the mug without removing the lid have been developed. Two such products are shown in U.S. Pat. Nos. 4,582,218 and 5,018,636.

In the mug of the U.S. Pat. No. 4,582,218 patent, a cylindrical portion 46 of the lid slides into a mating sidewall portion of the mug to engage a shelf 30. The lid is locked in place by mating keys 48, 50 and gaps 52, 54, with a friction seal 60 at the upper end of the lid, and with a handle 70 in the well 62 in the cylindrical portion of the lid. This prior design requires a rather complex structure, particularly for the lid, and was replaced by the design of U.S. Pat. No. 5,018,636 by the same patentee.

The later patent states that it is an improvement in the mug body design to facilitate ease of manufacture and an improvement in the top which provides better sealing and more efficient insertion and removal.

The later patent mug uses a continuous shelf 30, with a hemispherical body 50 and flexible spheres 54, 74 projecting downward from the lid for sealing engagement with the shelf. While this design is simpler than that of the earlier patent, it does not provide for positive restraint of the lid in the mug.

It is an object of the present invention to provide a new and improved drink mug with lid which is simple in construction and in operation and at the same time provides a positive interconnection between the lid and mug. Other objects, advantages, features and results will more fully appear in the course of the following description.

SUMMARY OF THE INVENTION

A drink mug with open top, closed bottom, and a body portion between the top and bottom, ring means defining an inwardly projecting ring in the body portion, passage means defining a vertical passage in the ring, latch notch means defining a notch in the body portion below the ring, a lid for resting on the ring, and a latch member carried on the lid and projecting downward therefrom, with the latch member passing through the vertical passage as the lid is positioned on the ring, and with the latch member positioned in the notch when the lid is rotated on the ring latching the lid in place on the ring.

In the preferred embodiment, two vertical passages opposite each other, and two notches opposite each other and at 90° to the vertical passages, and flexible fingers connecting the latch members to the lid.

BRIEF DESCRIPTION OF THE DRAWINGS

FIG. 1 is an exploded view of the presently preferred embodiment of the invention;

FIG. 2 is a top view of the mug of FIG. 1 with the lid in the insertion and removal position;

FIG. 3 is a view similar to that of FIG. 2 with the lid in the latched position;

FIG. 4 is a sectional view taken along the line 4—4 of FIG. 2; and

FIG. 5 is a partial sectional view taken along the line 5—5 of FIG. 3.

DESCRIPTION OF THE PREFERRED EMBODIMENT

The mug 11 illustrated in the drawing figures includes an open top 12, a closed bottom 13, and a body portion 14 between the top and bottom. The open top is closed with a lid 15. An inwardly projecting ring 16 is formed in the body portion adjacent the top, with vertical passages 17 formed in the ring and with latch notches 18 formed in the body portion below the ring.

Preferably, the body portion between the top and bottom is frustoconical in shape, and includes a handle 21. Also preferably, there are two vertical passages 17 positioned opposite each other and two latch notches 18 positioned opposite each other, with the latch notches rotated relative to the passages, typically at 90°. With this construction, the upper surfaces 22 of the latch notches are formed by the ring 16.

The preferred embodiment of the lid 15 includes a flat disc 25 with an opening 26 for drinking, and desirably a handle 27 projecting upward from the disc 25.

Latch members 29 are carried on the lid, typically by flexible fingers 30, and in the preferred embodiment the disc, handle, fingers and latch members of the lid are molded as a single piece. Preferably the latch members 29 are cylindrical with rounded ends and are disposed generally vertical as seen in FIG. 5, with the flexible fingers 30 connected to the latch members at the inner surfaces of the members intermediate the upper and lower ends thereof.

In use, the lid is positioned at the top of the mug with the latch members aligned with the vertical passages through the ring, and the lid is pushed downward into the mug so that the disc of the lid rests on the top of the ring of the mug, as shown in FIG. 4. With this arrangement, the latch members are below the ring, which permits the lid to be rotated to bring the latch members into position at the latch notches, as seen in FIG. 5. The latch members are connected to the disc of the lid so that when the latch members are unrestrained, they assume a position a bit further apart than is permitted by the latch notches. Then when the lid is rotated to position the latch members at the latch notches, the latch members are urged outward into engagement with the notches. This construction provides for securing the lid in the mug and substantially prevents raising of the lid directly up from the mug. Thus if the mug is turned over for any reason, the lid will remain in place. The lid is removed by rotating it 90° in the mug to move the latch members out of the latch notches and align the latch members with the vertical passages. Then the lid is readily raised from the mug.

I claim:

1. A drink mug with open top, closed bottom, and a body portion between said top and bottom, ring means defining an inwardly projecting ring within said body portion below said open top, passage means defining a vertical passage in said ring, latch notch means defining a notch in said body portion below said ring, a lid for resting on said ring within said open top, said lid having an opening for drinking from said mug, and a latch member carried on said lid and projecting downward therefrom, with said latch member passing through said vertical passage as said lid is positioned on said ring within said open top, and with said latch member positioned in said notch when said lid is rotated on said ring latching said lid in place on said ring.

2. A mug as defined in claim 1 including a flexible finger connecting said latch member to said lid.

3. A mug as defined in claim 2 including two of said vertical passages opposite each other, two of said notches opposite each other and at 90° to said vertical passages, and two of said latch members.

4. A mug as defined in claim 1 including two of said vertical passages opposite each other, two of said notches opposite each other and at 90° to said vertical passages, and two of said latch members.

5. A drink mug with open top, closed bottom, and a body portion between said top and bottom, ring means defining an inwardly projecting ring in said body portion, passage means defining two vertical passages in said ring opposite each other, latch notch means defining two notches in said body portion below said ring opposite each other and at 90° to said vertical passages, a lid for resting on said ring, latch members carrie don said lid and projecting downward therefrom, with said latch members passing through said vertical passages as said lid is positioned on said ring, and with said latch members positioned in said notches when said lid is rotated on said ring latching said lid in place on said ring, and flexible fingers connecting said latch members to said lid, with said body portion being frustoconical below said ring, with said vertical passages and notches projecting outward from said body portion, and with said ring forming the upper limits of said notches.

6. A mug as defined in claim 5 wherein said lid is flat with a handle projecting upward and flexible fingers projecting downward carrying said latch members.

7. A mug as defined in claim 6 wherein said latch members are cylindrical and disposed generally vertical, with said fingers connected to said latch members at the inner surfaces of said latch members intermediate the upper and lower ends of the latch members.

8. A drink mug with open top, closed bottom, and a body portion between said top and bottom, ring means defining an inwardly projecting ring in said body portion, passage means defining two vertical passages in said ring opposite each other, latch notch means defining two notches in said body portion below said ring opposite each other and at 90° to said vertical passages, a lid for resting on said ring, and latch members carrie don said lid and projecting downward therefrom, with said latch members passing through said vertical passages as said lid is positioned on said ring, and with said latch members positioned in said notches when said lid is rotated on said ring latching said lid in place on said ring, said body portion being frustoconical below said ring, with said vertical passages and notches projecting outward from said body portion, and with said ring forming the upper limits of said notches.

9. A mug as defined in claim 8 wherein said lid is flat with a handle projecting upward and flexible fingers projecting downward carrying said latch members.

10. A mug as defined in claim 9 wherein said latch members are cylindrical and disposed generally vertical, with said fingers connected to said latch members at the inner surfaces of the latch members intermediate the upper and lower ends of the latch members.

* * * * *